US005240519A

United States Patent [19]

Kamio et al.

[11] Patent Number: 5,240,519

[45] Date of Patent: Aug. 31, 1993

[54] ALUMINUM BASED MG-SI-CU-MN ALLOY HAVING HIGH STRENGTH AND SUPERIOR ELONGATION

[75] Inventors: Hajime Kamio; Toru Yamada; Kenji Tsuchiya, all of Ihara, Japan

[73] Assignees: Nippon Light Metal Company, Ltd.; Nikkei Techno-Research, both of Tokyo, Japan

[21] Appl. No.: 931,251

[22] Filed: Aug. 17, 1992

[30] Foreign Application Priority Data

Aug. 28, 1991 [JP] Japan ..... 3-242578

[51] Int. Cl.[5] ..... C22C 21/00

[52] U.S. Cl. ..... 148/415; 420/533; 420/534; 420/535

[58] Field of Search ..... 148/415; 420/533, 534, 420/535

[56] References Cited

U.S. PATENT DOCUMENTS

| | | | |
|---|---|---|---|
| 4,605,448 | 8/1986 | Baba et al. | 148/415 |
| 4,637,842 | 1/1987 | Jeffrey et al. | 148/415 |
| 4,784,921 | 11/1988 | Hyland et al. | 420/534 |
| 4,808,247 | 2/1989 | Konatsubara et al. | 148/415 |
| 4,909,861 | 3/1990 | Muraoka et al. | 148/415 |

FOREIGN PATENT DOCUMENTS

| | | | |
|---|---|---|---|
| 0167757 | 10/1983 | Japan | 420/535 |
| 0050147 | 3/1984 | Japan | 420/535 |
| 1015938 | 1/1986 | Japan | 420/535 |
| 1-283337 | 11/1989 | Japan . | |

*Primary Examiner*—Upendra Roy

*Attorney, Agent, or Firm*—McAulay, Fisher, Nissen, Goldberg & Kiel

[57] ABSTRACT

An aluminum alloy consisting of: 1.0–1.5 wt % Si, 0.4–0.9 wt % Cu, 0.2–0.6 wt % Mn, 0.8–1.5 wt % Mg, 0.3–0.9 wt % Cr, 0.03–0.05 wt % Ti, 0.0001–0.01 wt % B, and the balance consisting of Al and unavoidable impurities; the sum of the Mn and Cr contents being not more than 1.2 wt % and the content of Fe as one of the unavoidable impurities being not more than 0.2 wt %. The alloy may further comprise 0.1–0.2 wt % Zr to facilitate the refinement of crystal grains. The alloy has a tensile strength of 40 kgf/mm$^2$ or more and an elongation of 15% or more when plastically formed, solution-treated and aged to provide the highest strength.

6 Claims, No Drawings

ALUMINUM BASED MG-SI-CU-MN ALLOY HAVING HIGH STRENGTH AND SUPERIOR ELONGATION

BACKGROUND OF THE INVENTION

1. Field of the Invention

The present invention relates to an aluminum alloy having a fine crystal structure and thereby having excellent mechanical properties, particularly strength and elongation.

2. Description of the Related Art

Al-Mg-Si aluminum-based alloys, particularly 6000-series aluminum alloys such as 6061, 6066, 6070 and 6082 are conventionally hot- or cold-worked or plastically formed by forging, rolling, extruding, etc. The 6061 alloy is most popular in such use, but has a relatively low tensile strength of 27–33 kgf/mm$^2$ and is used as a medium strength material.

The 6000-series alloys are plastically formed to a desired form having increased strength and then subjected to a heat treatment such as $T_6$ treatment comprising a solution heat treatment and a subsequent artificial ageing under a condition providing the highest aged strength. The heat treatment, however, coarsens the recrystallized crystal grains generated during the hot plastic working and thereby reduces the mechanical properties, particularly strength and elongation. The coarsening of recrystallized grains is particularly evident when worked at a high reduction or working ratio of 50% or more.

Japanese Unexamined Patent Publication (Kokai) No. 1-283337 proposed suppressing the grain coarsening by using the additive elements of Mn, Cr, Zr, etc., in which it is stated that Mn, Cr and Zr when jointly added to Al-Mg-Si aluminum-based alloys in a certain amount, suppresses the grain growth otherwise occurring during forging or other forming processes and during heat treatments and thereby provides a plastically formed article having a refined crystal structure.

It is a current trend that materials applied to automobile parts such as the frame and suspension members require a tensile strength of 40 kgf/mm$^2$ or higher and an elongation of 15% or more when plastically formed and $T_6$-heat-treated. The above-proposed aluminum alloy, however, does not satisfy this requirement because of poor mechanical properties involving tensile strength, proof strength and elongation, although it has improved characteristics resulting from the refined crystal structure in comparison with other existing materials.

The conventional practical aluminum alloys, such as the 6000-series alloys, do not provide a tensile strength of 40 kgf/mm$^2$ or higher and an elongation of 15% or more when a cast material is hot- or cold-worked and $T_6$-heat-treated, the hot- and cold-working being usually effected by forging or rolling with or without an antecedent hot-extrusion.

SUMMARY OF THE INVENTION

An object of the present invention is to eliminate the above-mentioned conventional problems of Al-Mg-Si aluminum-based alloys and thereby provide an aluminum alloy in which the contents of alloying elements such as Cu, Cr, Mn and Zr are systematically controlled to improve the matrix strength and suppress the crystal grain coarsening so that excellent mechanical properties, including a tensile strength of 40 kgf/mm$^2$ or higher and an elongation of 15% or more, are achieved when plastically worked and $T_6$-heat-treated to provide parts and structural members having the characteristic lightweight nature of aluminum alloys.

Another object of the present invention is provide a plastically formed aluminum alloy article composed of the above-mentioned alloy.

To achieve the object according to the present invention, there is provided an aluminum alloy consisting, in wt %, of:

Si: 1.0–1.5,
Cu: 0.4–0.9,
Mn: 0.2–0.6,
Mg: 0.8–1.5,
Cr: 0.3–0.9,
Ti: 0.03–0.05,
B: 0.0001–0.01, and the balance consisting of Al and unavoidable impurities; the sum of the Mn and Cr contents being not more than 1.2 wt % and the content of Fe as one of the unavoidable impurities being not more than 0.2 wt %.

There is also provided according to the present invention, an aluminum alloy consisting, in wt %, of:

Si: 1.0–1.5,
Cu: 0.4–0.9,
Mn: 0.2–0.6,
Mg: 0.8–1.5,
Cr: 0.3–0.9,
Ti: 0.03–0.05,
Zr: 0.1–0.2,
B: 0.0001–0.01, and the balance consisting of Al and unavoidable impurities; the sum of the Mn and Cr contents being not more than 1.2 wt % and the content of Fe as one of the unavoidable impurities being not more than 0.2 wt %.

There is also provided according to the present invention a plastically formed article composed of an aluminum alloy of the present inventive alloy.

According to the present invention, an aluminum alloy and a plastically formed article made of the inventive alloy has a tensile strength of 40 kg/mm$^2$ or more and an elongation of 15% or more when plastically formed, solution-treated and aged to provide the highest strength.

DESCRIPTION OF THE PREFERRED EMBODIMENTS

The Al-Mg-Si aluminum-based alloys have a strength ensured by the particles of an $Mg_2Si$ phase precipitated in a matrix of a solid solution phase. The alloy strength is further increased by a solid solution strengthening of the matrix effected by additive elements such as Cu, Cr and Mn.

To provide an aluminum alloy having a strength greater than that of the conventional 6061 alloy, it is a primary idea to increase the amount of the $Mg_2Si$ precipitate by increasing the contents of Si and Mg. Simply increasing the Si and Mg contents, however, not only reduces elongation and toughness but also fails to provide the intended increased strength.

The present inventors made extensive studies of the influence of the $Mg_2Si$ precipitate on the mechanical properties and the influence of the $T_6$-heat treatment on the grain growth of the plastically worked macrostructure and found that it is essential to employ alloying elements and determine the contents thereof while considering the interrelationship therebetween so as to utilize the advantageous effect of the $Mg_2Si$ precipitate and suppress the crystal grain growth of the macrostructure.

To ensure the necessary effect of the $Mg_2Si$ precipitate and also refine the macrostructure, the present inventors found that the Si and Mg contents must be from 1.0 to 1.5 wt % and from 0.8 to 1.5 wt %, respectively. Si and Mg contents falling within these ranges, however, cannot completely avoid the coarsening of a macrostructure and the resulting degradation of mechanical properties such as strength and elongation because of a rapid growth of recrystallized grains occurring when a hot-extruded material is $T_6$-heat-treated or a hot- or cold-forged material is $T_6$-heat-treated.

The simultaneous addition (hereinafter referred to as "co-addition") of Cr and Mn advantageously suppresses the coarsening of recrystallized grains that otherwise occurs when a hot- or cold-worked structure is subjected to a heat treatment, and the thus-obtained aluminum alloy has a refined crystal structure and improved strength and elongation. This favorable effect brought about by the co-addition of Cr and Mn is believed to be due to the prevention of the recrystallized grains from growing coarse during the $T_6$-heat treatment of a hot- or cold-worked material.

The co-addition of Zr together with Cr and Mn further increases elongation and further refines the crystal structure, because Zr effectively refines the recrystallized grains when a plastic working is carried out at a high working ratio where Cr and Mn are no longer effective in suppressing the growth of recrystallized grains.

The alloying elements according to the present invention must be present in the respective specified amounts for the following reasons.

Silicon (Si) improves the strength of an aluminum alloy by a precipitation strengthening effect, i.e., Si forms a $Mg_2Si$ compound with the coexisting Mg. The strengthening effect of Si is significant when present in an amount of 1.0 wt % or more. An excessively increased Si content, however, not only raises the liquidus temperature of an alloy, which is unfavorable for melting and casting of the alloy, but also lowers the formability upon extrusion, forging, etc. Accordingly, the Si content must be 1.0 wt % or more but not more than 1.5 wt %.

Copper (Cu) solution-strengthens the matrix phase of an alloy and also facilitates precipitation strengthening by the $Mg_2Si$ precipitate phase, and accordingly, Cu must be present in an amount of 0.4 wt % or more. Cu when present in an amount greater than 0.9 wt %, however, reduces the corrosion resistance of an alloy. Therefore, the Cu content must be from 0.4 to 0.9 wt %.

Manganese (Mn) suppresses the growth of crystal grains to ensure a fine heat-treated structure, and accordingly, must be present in an amount of 0.2 wt % or more. A Mn amount exceeding 0.6 wt %, however, degrades the hot- and cold-formability. Therefore, the Mn content must be from 0.2 to 0.6 wt %.

Magnesium (Mg) reacts with Si to form a $Mg_2Si$ compound phase precipitated in the matrix phase of an aluminum alloy to increase the strength. To ensure this precipitation strengthening effect, Mg must be present in an mount of 0.8 wt % or more. Mg present in an amount of more than 1.5 wt %, however, provides no further precipitation. Therefore, the Mg content must be from 0.8 to 1.5 wt %.

Chromium (Cr) cooperates with Mn in suppressing the coarsening of crystal grains, and to this end, must be present in an amount of 0.3 wt % or more but reduces the formability when present in an amount of more than 0.9 wt %. Therefore, the Cr content must be from 0.3 to 0.9 wt %.

The sum of the Mn and Cr contents must be not more than 1.2 wt % to ensure the above-mentioned favorable effect of co-addition of these elements without causing undesired effects to the alloy properties. When the sum of the Mn and Cr contents is greater than 1.2 wt %, the precipitation of coarse particles of Al-Mn-Cr compounds is facilitated to significantly reduce the elongation.

Titanium (Ti) refines the crystal grains of the as-cast structure, particularly when present in an amount of 0.03 wt % or more. The refined crystal grains are not only favorable for the mechanical properties of a final product but also suppress the occurrence of casting cracks and other defects of a billet. The Ti content, however, must not be more than 0.05 wt % to ensure the toughness of an aluminum alloy.

Boron (B), like Ti, refines the crystal grains, particularly when present in an amount of 0.0001 wt % or more. The upper limit of the B content must be 0.01 wt % for the same reason as Ti.

Iron (Fe) is unavoidably present as an impurity element in an aluminum alloy and forms an Al-Fe-Si compound in the form of particles dispersed in the alloy matrix to cause an undesired effect to the elongation and the corrosion resistance. The Fe content must then be as small as possible but the reduction of the Fe content is practically limited by the corresponding increase in the difficulty of the melting process. Accordingly, the upper limit of the Fe content is specified as 0.2 wt %, at and below which Fe does not substantially cause an undesired influence on the alloy properties.

Zirconium (Zr) cooperates with Mn and Cr in suppressing the coarsening of crystal grains. Zr also improves the tensile strength of an extruded and forged article by maintaining the fiber structure established during the extrusion. The favorable effects of Zr are particularly significant when present in an amount of 0.1 wt % or more. The Zr content must not be more than 0.2 wt % because a greater amount of Zr causes an undesirable effect to the formability.

An aluminum alloy according to the present invention is cast, for example, by continuous casting, to a billet, which is hot- and/or cold-worked to a desired form and then $T_6$-heat-treated to provide a product. The hot-working is typically effected by forging with or without a preceding extrusion to a bar or cylindrical form. The thus-obtained product has a tensile strength of 40 kgf/mm$^2$ or higher and an elongation of 15% or more.

A cast billet is preferably extruded prior to forgoing to further enhance both the strength and the elongation.

EXAMPLE 1

Aluminum alloys having different chemical compositions summarized in Table 1 were melted in a 500 kg-electric resistance furnace in air and continuous-cast to a 325 mm dia., 600 mm long billet. The billets were heated to a temperature of from 450° to 500° C. by induction heating and hot-extruded to 74 mm dia. round bars by a 3900 ton-indirect hot extruding machine at a speed of from 5 to 8 m/min and allowed to cool to room temperature. The hot-extruded round bars were then re-heated to a temperature of 450°±10° C. in an electric, hot air blow furnace and hot-forged by upsetting the bars in one stroke in the direction of the bar diameter in a 400 ton-oil hydraulic press with an initial temperature of 440°–450° C. and a final temperature of 390°–410° C. and at a working ratio (Re) of 60% in terms of a value calculated by Re(%)=100×(HO−H)/HO, with HO being the initial height or diameter of an as-extruded material and H being the final height of an upset material.

Some samples were prepared by omitting the extrusion, i.e., by surface machining 84 mm dia. cast billets, heating at 540° C. for 8 hours for homogenization or thermal equalization, and then forging under the same conditions as above.

TABLE 1

| Alloy No. | Chemical composition (wt %: balance Al and impurities) Si | Fe | Cu | Mn | Mg | Cr | Ti | Zr | B | Mn + Cr | Remarks |
|---|---|---|---|---|---|---|---|---|---|---|---|
| 1 | 1.26 | 0.16 | 0.81 | 0.25 | 0.99 | 0.41 | 0.03 | ≦0.0003 | 0.002 | 0.66 | Invention |
| 2 | 1.19 | 0.15 | 0.76 | 0.38 | 0.95 | 0.39 | 0.03 | ≦0.0003 | 0.002 | 0.77 | |
| 3 | 1.21 | 0.14 | 0.82 | 0.25 | 0.98 | 0.37 | 0.03 | 0.13 | 0.002 | 0.62 | |
| 4 | 1.21 | 0.15 | 0.83 | 0.41 | 1.01 | 0.36 | 0.04 | 0.14 | 0.003 | 0.77 | |
| 5 | 1.60 | 0.15 | 0.50 | 0.39 | 1.60 | 0.90 | 0.03 | ≦0.0003 | 0.002 | 1.29 | Comparison |
| 6061 | 0.66 | 0.20 | 0.32 | 0.01 | 1.00 | 0.12 | 0.01 | ≦0.0003 | ≦0.001 | 0.13 | |
| 6066 | 1.39 | 0.24 | 1.02 | 0.84 | 1.12 | 0.01 | 0.02 | ≦0.0003 | ≦0.001 | 0.85 | |
| 6070 | 1.41 | 0.22 | 0.29 | 0.67 | 0.86 | 0.01 | 0.01 | ≦0.0003 | ≦0.001 | 0.68 | |
| 6082 | 1.02 | 0.22 | 0.01 | 0.50 | 0.90 | 0.08 | 0.01 | ≦0.0003 | ≦0.001 | 0.58 | |
| 6 | 1.23 | 0.16 | 0.49 | 0.25 | 1.00 | 0.40 | 0.04 | ≦0.0003 | 0.003 | 0.65 | Invention |
| 7 | 1.16 | 0.15 | 0.47 | 0.39 | 0.95 | 0.39 | 0.03 | ≦0.0003 | 0.002 | 0.78 | |
| 8 | 1.21 | 0.15 | 0.47 | 0.35 | 0.97 | 0.41 | 0.03 | 0.13 | 0.002 | 0.76 | Comparison |
| 9 | 1.70 | 0.14 | 0.52 | 0.40 | 1.61 | 0.88 | 0.03 | ≦0.0003 | 0.002 | 1.28 | |
| 6061 | 0.60 | 0.26 | 0.30 | 0.01 | 1.10 | 0.12 | 0.03 | ≦0.0003 | 0.002 | 0.13 | |
| 6066 | 1.33 | 0.23 | 0.91 | 0.87 | 1.14 | 0.01 | 0.03 | ≦0.0003 | 0.002 | 0.88 | |
| 6070 | 1.43 | 0.21 | 0.28 | 0.68 | 0.89 | 0.01 | 0.03 | ≦0.0003 | 0.002 | 0.69 | |

The forged materials were $T_6$-heat-treated by heating at 530° C. for 2 hours, water quenching and re-heating or ageing at 175° C. for 8 hours.

The crystal grain diameter of the heat-treated materials was determined by optical microscopic observation at a magnification of 4, specifically by counting the number of crystal grains intersecting 2 mm long horizontal and vertical imaginary lines on a 20 mm wide, 6 mm thick cross section cut along the forging or upsetting direction and dividing the total length of 4 mm or 4000 μm by the counted number. For example, when the counted number of crystal grains is 20, the estimated grain diameter is 200 μm. To carry out this observation, grain boundaries on the cross section were revealed by etching using a Tucker's etchant having a composition of 10 g HCl, 15 g HF, 15 g $HNO_3$ and 25 g $H_2O$.

Tensile test was also carried out to determine the tensile strength, proof strength and elongation.

The results thus obtained are summarized in Table 2.

TABLE 2

| Alloy No. | Process | Grain diameter μm | Tensile strength kgf/mm² | 0.2% Proof strength kgf/mm² | Elongation % | Remarks |
|---|---|---|---|---|---|---|
| 1 | | 200–600 | 43.5 | 37.8 | 15.5 | Invention |
| 2 | C | 150–400 | 44.3 | 38.5 | 17.0 | |
| 3 | ↓ | 120–350 | 43.1 | 37.8 | 17.7 | |
| 4 | E | 120–250 | 43.6 | 38.1 | 17.3 | |
| 5 | ↓ | 150–400 | 41.0 | 40.0 | 6.0 | Comparison |
| 6061 | F | 400–1000 | 33.1 | 28.8 | 20.9 | |
| 6066 | ↓ | 250–650 | 36.7 | 32.0 | 14.4 | |
| 6070 | $T_6$ | 300–600 | 36.3 | 31.5 | 11.8 | |
| 6082 | | 400–500 | 33.1 | 30.2 | 8.7 | |
| 6 | | 120–300 | 40.7 | 35.5 | 15.1 | Invention |
| 7 | C | 120–220 | 41.2 | 36.4 | 15.0 | |
| 8 | ↓ | 120–210 | 40.1 | 35.7 | 15.2 | |
| 9 | F | 120–200 | 38.0 | 36.0 | 6.0 | Comparison |
| 6061 | ↓ | 250–400 | 32.4 | 28.3 | 14.7 | |
| 6066 | $T_6$ | 260–300 | 38.0 | 31.9 | 9.2 | |
| 6070 | | 300–450 | 38.4 | 32.6 | 7.5 | |

(Note) C: casting, E: extruding, F: forging, $T_6$: $T_6$–heat-treating.

It can be seen from Table 2 that Alloy Nos. 1–4 and 6–8 according to the present invention had a high tensile strength of 40 kgf/mm² or higher and a large elongation of 15% or more, whether or not extrusion was carried out prior to forging.

In conventional alloys 6061, 6066, 6070 and 6082, a maximum tensile strength was as low as 38.4 kgf/mm² at the expense of elongation, as shown by Alloy 6070 exhibiting a very small elongation of 7.5%.

Comparative alloy No. 5, having excessive amounts of Si and Mn and a (Mn + Cr) amount of more than 1.2 wt %, had a high tensile strength of 41 kgf/mm² but had a very small elongation of 6%. Comparative alloy No. 9 also contained excessive amounts of Si, Mn and (Mn + Cr), and the Si content, which was much more than that of alloy No. 5, exhibited both poor tensile strength of 38 kgf/mm² and elongation of 6%.

To separately depict the effect of the (Mn + Cr) content alone, comparative alloy No. 10 containing an excessive amount of (Mn + Cr) and specified amounts of other elements as shown in Table 3 was prepared by melting, casting, extruding, forging and $T_6$-heat treating under the same conditions as for the preceding alloys and subjected to a tensile test. As can be seen from Table 3, alloy No. 10 having a (Mn + Cr) content of 1.28 wt %, which is more than the specified upper limit of 1.2 wt %, had poor elongation of 8.6%.

TABLE 3

| Alloy No. | Chemical composition (wt %) Si | Fe | Cu | Mg | Mn | Cr | Ti | B | Mn + Cr | Tensile strength kgf/mm² | 0.2% Proof strength kgf/mm² | Elongation % |
|---|---|---|---|---|---|---|---|---|---|---|---|---|
| 10 | 1.24 | 0.15 | 0.80 | 0.96 | 0.63 | 0.65 | 0.03 | 0.004 | 1.28 | 44.4 | 41.9 | 8.6 |

To further clarify the effect of the copper content, four alloys (Nos. 11–14) having chemical compositions shown in Table 4 were prepared by the same process steps under the same conditions as alloy No. 10, except that 97 mm dia. cast billets were hot extruded to 20 mm dia. bars, which were then $T_6$-heat-treated. The thus-prepared alloy samples were subjected to a tensile test and a salt spray test. The test results are summarized in Table 5.

TABLE 4

| Alloy No. | Chemical composition (wt %) Si | Fe | Cu | Ti | Mn | Mg | Zn | Cr | B | Mn + Cr |
|---|---|---|---|---|---|---|---|---|---|---|
| 11 | 1.31 | 0.16 | 0.38 | 0.03 | 0.40 | 1.05 | 0.01≧ | 0.39 | 0.002 | 0.79 |
| 12 | 1.27 | 0.16 | 0.61 | 0.03 | 0.40 | 1.01 | 0.01≧ | 0.40 | 0.003 | 0.80 |
| 13 | 1.28 | 0.16 | 0.80 | 0.03 | 0.40 | 1.03 | 0.01≧ | 0.40 | 0.003 | 0.80 |
| 14 | 1.26 | 0.16 | 1.02 | 0.03 | 0.40 | 1.01 | 0.01≧ | 0.40 | 0.005 | 0.80 |

(Note) Alloy Nos. 12 and 13 have Cu contents within the specified range. Alloy Nos. 11 and 14 have Cu contents smaller than the lower limit and greater than the upper limit of the specified range, respectively.

TABLE 5

| Alloy No. | Tensile strength kgf/mm² | 0.2% Proof strength kgf/mm² | Elongation % | Average corrosion pit depth (μm) 500 hrs. | 1000 hrs. |
|---|---|---|---|---|---|
| 11 | 39.7 | 36.8 | 15.4 | 82.1 | 95.0 |
| 12 | 42.9 | 39.5 | 15.0 | 88.9 | 105.8 |
| 13 | 43.8 | 40.3 | 14.9 | 92.5 | 126.6 |
| 14 | 44.6 | 41.3 | 14.1 | 115.4 | 197.7 |

(Note 1) An average pit depth of more than 150 μm in a 1000 hr-salt spray test is an indication of a reduction in fatigue strength, which is detrimental to the members of the automobile foot assembly.
(Note 2) Test pieces were continuously sprayed with a 3.5% NaCl solution maintained at 35° C. and the test piece surface was microscopically observed after the spraying.

It can be seen from Table 5 that the copper content must be 0.4 wt % or more to ensure a tensile strength of 40 kgf/mm² or higher but must be 0.9 wt % or less to ensure good corrosion resistance in terms of, for example, an average corrosion pit depth of less than 150 μm in a 1000 hr-salt spray test.

As hereinabove described, the present invention provides an Al-Mg-Si aluminum-based alloy having a high strength imparted by the $Mg_2Si$ precipitate, in which the contents of alloying elements such as Cu, Cr, Mn and Zr are systematically controlled to suppress the crystal grain coarsening otherwise occurring during a plastic working and heat treatment process and thereby improve mechanical properties such as tensile strength, proof strength and elongation, so that the alloy can be applied for parts of automobiles and other vehicles and the structural members of machinery.

We claim:

1. An aluminum alloy consisting, in wt %, of:
Si: 1.0–1.5,
Cu: 0.4–0.9,
Mn: 0.2–0 6,
Mg: 0.8–1.5,
Cr: 0.3–0.9,
Ti: 0.03–0.05,
B: 0.0001–0.01, and
the balance consisting of Al and unavoidable impurities; the sum of the Mn and Cr contents being not more than 1.2 wt % and the content of Fe as one of the unavoidable impurities being not more than 0.2 wt %.

2. An aluminum alloy according to claim 1, having a tensile strength of 40 kgf/mm² or more and an elongation of 15% or more when plastically formed, solution-treated and aged to provide the highest strength.

3. A plastically formed article made of an aluminum alloy consisting, in wt %, of:
Si: 1.0–1.5,
Cu: 0.4–0.9,
Mn: 0.2–0.6,
Mg: 0.8–1.5,
Cr: 0.3–0.9,
Ti: 0.03–0.05,
B: 0.0001–0.01, and
the balance consisting of Al and unavoidable impurities; the sum of the Mn and Cr contents being not more than 1.2 wt % and the content of Fe as one of the unavoidable impurities being not more than 0.2 wt %.

4. An aluminum alloy consisting, in wt %, of:
Si: 1.0–1.5,
Cu: 0.4–0.9,
Mn: 0.2–0.6,
Mg: 0.8–1.5,
Cr: 0.3–0.9,
Ti: 0.03–0.05,
Zr: 0.1–0.2,
B: 0.0001–0.01, and
the balance consisting of Al and unavoidable impurities; the sum of the Mn and Cr contents being not more than 1.2 wt % and the content of Fe as one of the unavoidable impurities being not more than 0.2 wt %.

5. An aluminum alloy according to claim 4 having a tensile strength of 40 kgf/mm² or more and an elongation of 15% or more when plastically formed, solution-treated and aged to provide the highest strength.

6. A plastically formed article made of an aluminum alloy consisting, in wt %, of:
Si: 1.0–1.5,
Cu: 0.4–0.9,
Mn: 0.2–0.6,
Mg: 0.8–1.5,
Cr: 0.3–0.9,
Ti: 0.03–0.05,
Zr: 0.1–0.2,
B: 0.0001–0.01, and
the balance consisting of Al and unavoidable impurities; the sum of the Mn and Cr contents being not more than 1.2 wt % and the content of Fe as one of the unavoidable impurities being not more than 0.2 wt %.

* * * * *